US007111932B2

(12) United States Patent
Steed et al.

(10) Patent No.: US 7,111,932 B2
(45) Date of Patent: Sep. 26, 2006

(54) MANAGING CONTAMINANTS IN A FLUID-DELIVERY DEVICE

(75) Inventors: Mike Steed, Corvallis, OR (US); Thomas H. Ottenheimer, Philomath, OR (US); Joseph R. Elliot, Corvallis, OR (US)

(73) Assignee: Hewlett-Packard Development Company, Houston, TX (US)

( * ) Notice: Subject to any disclaimer, the term of this patent is extended or adjusted under 35 U.S.C. 154(b) by 313 days.

(21) Appl. No.: 10/666,753

(22) Filed: Sep. 18, 2003

(65) Prior Publication Data

US 2005/0062817 A1 Mar. 24, 2005

(51) Int. Cl.
*B41J 2/19* (2006.01)

(52) U.S. Cl. ..... 347/92

(58) Field of Classification Search ..... 347/56, 347/89, 92, 93

See application file for complete search history.

(56) References Cited

U.S. PATENT DOCUMENTS

| | | | | |
|---|---|---|---|---|
| 4,929,963 | A * | 5/1990 | Balazar | 347/89 |
| 5,479,196 | A | 12/1995 | Inada | |
| 5,600,349 | A | 2/1997 | Keefe | |
| 5,700,315 | A | 12/1997 | Wenzel | |
| 5,856,835 | A | 1/1999 | Umeda et al. | |
| 5,886,715 | A | 3/1999 | Fukuoka | |
| 5,900,889 | A | 5/1999 | Tsukuda | |
| 6,033,060 | A | 3/2000 | Minami | |
| 6,036,299 | A | 3/2000 | Kobayashi et al. | |
| 6,042,218 | A | 3/2000 | Nakahara | |
| 6,062,681 | A | 5/2000 | Field et al. | |
| 6,145,952 | A | 11/2000 | Sharma et al. | |
| 6,179,406 | B1 | 1/2001 | Ito et al. | |
| 6,193,355 | B1 | 2/2001 | Nakamura | |
| 6,213,581 | B1 | 4/2001 | Hasegawa et al. | |
| 6,276,778 | B1 | 8/2001 | Katayama | |
| 6,283,573 | B1 | 9/2001 | Nakamura | |
| 6,296,342 | B1 | 10/2001 | Oikawa | |
| 6,312,087 | B1 | 11/2001 | Imai et al. | |
| 6,312,089 | B1 | 11/2001 | Imai | |
| 6,334,662 | B1 | 1/2002 | Hollands | |
| 6,336,700 | B1 | 1/2002 | Hays et al. | |
| 6,357,852 | B1 | 3/2002 | Premnath et al. | |
| 6,382,764 | B1 | 5/2002 | Shimoda | |
| 6,386,677 | B1 | 5/2002 | Imai et al. | |
| 6,406,125 | B1 | 6/2002 | Jackson | |
| 6,457,802 | B1 | 10/2002 | Jackson | |
| 6,520,633 | B1 * | 2/2003 | Nakamura | 347/93 |
| 6,547,379 | B1 * | 4/2003 | Chan et al. | 347/92 |
| 6,799,837 | B1 * | 10/2004 | Chen et al. | 347/56 |
| 2001/0028374 | A1 | 10/2001 | Ogawa et al. | |
| 2001/0050697 | A1 | 12/2001 | Jackson | |
| 2002/0005874 | A1 | 1/2002 | Imai et al. | |

FOREIGN PATENT DOCUMENTS

| | | |
|---|---|---|
| JP | 05092565 | 4/1993 |
| JP | 2001038926 | 2/2001 |
| JP | 2001038927 | 2/2001 |

* cited by examiner

*Primary Examiner*—K. Feggins

(57) ABSTRACT

Methods and systems for managing contaminants are described. One exemplary method ejects fluid from multiple ejection chambers of a printing device in a pattern designed primarily to create fluid flow to move a contaminant present in fluid contained in a fluid-feed channel configured to supply fluid to the multiple ejection chambers. Responsive to the ejection, the method moves fluid in the fluid-feed channel sufficiently to move a contaminant in a desired direction within the fluid-feed channel.

33 Claims, 10 Drawing Sheets

MANAGING CONTAMINANTS IN A FLUID-DELIVERY DEVICE

BACKGROUND

Contaminants, such as bubbles, can be present in various fluid-delivery devices. In some fluid-delivery devices contaminants can reduce and/or occlude fluid flow and cause the device to malfunction. Management of the contaminants can enhance the performance and reliability of the fluid-delivery device. For these and other reasons, there is a need for the present invention.

BRIEF DESCRIPTION OF THE DRAWINGS

The same components are used throughout the drawings to reference like features and components wherever possible. Alphabetic suffixes are utilized to distinguish various embodiments. The diagrammatic representations shown herein are for illustrative purposes and may not be to scale.

DETAILED DESCRIPTION

Figure 1:
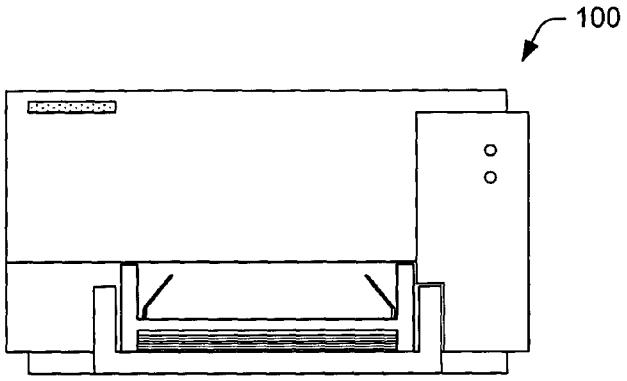
FIG. 1 shows a front elevational view of an exemplary printer in accordance with one embodiment.

The embodiments described below pertain to methods and systems for managing contaminants along a fluid-feed path in a micro electro mechanical systems ("MEMS") device such as a print cartridge or other fluid-delivery device. Several of the described embodiments are provided in the context of bubble management along a fluid-feed path of a print cartridge for use in a printing device. As such, the term "ink" will be used in the following description, but other fluids are utilized in suitable embodiments. Similarly, various other contaminants alternatively or additionally to bubbles can also be managed utilizing the described embodiments.

Print cartridges commonly comprise a cartridge body connected to a print head. Ink can be supplied from and/or through the cartridge body along a fluid-feed path to fluid ejecting elements contained in and/or proximate to ejection chambers within the print head.

In some embodiments, the fluid-feed path can comprise one or more fluid-feed channels, examples of which will be described in the context of fluid feed slots ("slots") and fluid feed passageways ("passageways"). In one embodiment, ink flows through a slot formed in a substrate into one or more passageways. In some embodiments, an individual passageway can supply an individual ejection chamber which contains a fluid ejecting element that can be energized sufficiently to eject ink from the ejection chamber via an ejection nozzle ("nozzle").

Contaminants such as bubbles and/or particles can be contained in the ink of a print cartridge. Bubbles can be formed, among other origins, in the ink as a byproduct of operation of a printing device. For example, bubbles can be formed as a byproduct of the ejection process in the printing device's print cartridge.

If bubbles or other contaminants accumulate along the fluid-feed path such as in the slot or passageway(s) they can occlude ink flow to some or all of the ejection chambers causing the print head to malfunction. Some embodiments can move bubbles in a desired direction to decrease the likelihood of such a malfunction. In one such example bubbles are moved to a structure designed to handle bubbles and/or prevent bubbles from causing such malfunctions. The structure, in handling the bubbles, may reduce the undesirable affects of bubbles within the fluid-feed path. For example, the structure may act as a storage reservoir and/or may evacuate the bubbles from the print head, among other functions.

Contaminants such as bubbles can be moved, among other ways, by the creation of fluid flow intended to move a bubble in a desired direction. Such fluid flow can be created, among other ways, by ejecting fluid from one or more firing chambers in a pattern designed primarily to create fluid flow in a desired direction.

In some embodiments, such fluid flow can move a bubble in a desired direction to a region where the bubble is more likely to migrate out of the fluid-feed path and/or position the bubble in a location that reduces the likelihood of the bubble causing ink occlusion to some or all of the ejection chambers.

FIG. 1 shows an exemplary printing device that can utilize bubble management as described below. In this embodiment, the printing device comprises a printer 100. The printer shown here is embodied in the form of an inkjet printer. The printer 100 can be capable of printing in black-and-white and/or color. The term "printing device" refers to any type of printing device and/or image forming device that employs a fluid-delivery device(s) such as a print cartridge to achieve at least a portion of its functionality. Examples of such printing devices can include, but are not limited to, printers, facsimile machines, photocopiers, and the like. Examples of other fluid delivery devices can include various MEMS devices such as Lab-On-A-Chip which are utilized in various laboratory and medical applications, among others.

Figure 1A:
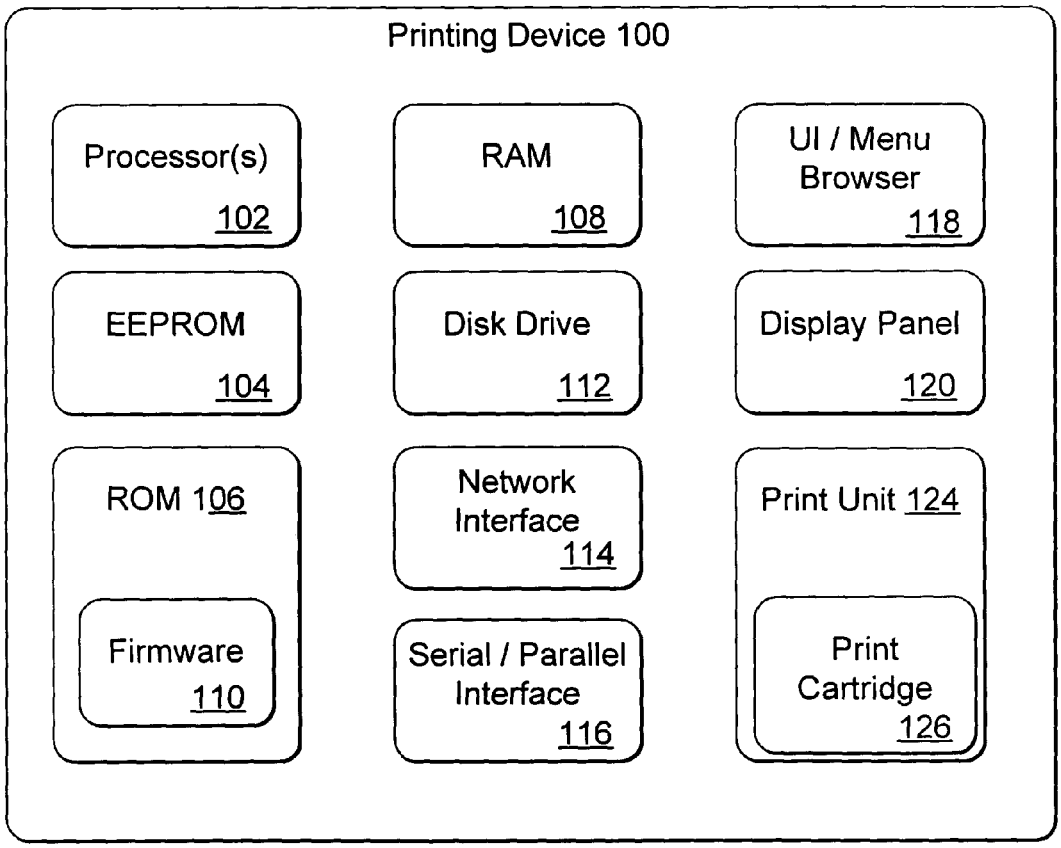
FIG. 1*a* shows a block diagram illustrating exemplary components of one exemplary printer.

FIG. 1*a* illustrates various components of the exemplary printing device 100. Printing device 100 may include one or more controllers that are embodied as one or more processors 102 to control various printing operations, such as media handling, servicing, and ink ejection.

Printing device 100 may have an electrically erasable programmable read-only memory (EEPROM) 104, ROM 106 (non-erasable), and a random access memory (RAM) 108. Although printing device 100 is illustrated as having an EEPROM 104 and ROM 106, a particular printing device may only include one of the memory components. Additionally, although not shown, a system bus may connect the various components within the printing device 100.

The printing device 100 may also have a firmware component 110 that is implemented as a permanent memory module stored on ROM 106. The firmware 110 is programmed and tested in a similar manner as for software, and is distributed with the printing device 100. The firmware 110 may be implemented to coordinate operations of the hardware within printing device 100 and contains programming constructs used to implement such operations.

Processor(s) 102 process various instructions to control the operation of the printing device 100 and to communicate with other electronic and computing devices. The memory components, EEPROM 104, ROM 106, and RAM 108, store various information and/or data such as configuration information, fonts, templates, data being printed, and menu structure information. Although not shown, a particular printing device may also include a flash memory device in place of or in addition to EEPROM 104 and ROM 106.

Printing device 100 may also include a disk drive 112, a network interface 114, and a serial/parallel interface 116, which can comprise any type of suitable interface. Examples of serial/parallel interface 116 can comprise a USB, and/or an IEEE 1394 compliant interface, among others. Disk drive 112 provides additional storage for data being printed or other information maintained by the printing device 100. Although printing device 100 is illustrated having both RAM 108 and a disk drive 112, a particular printing device may include either RAM 108 or disk drive 112, depending on the storage needs of the printer. For example, some printing devices may include a small amount of RAM 108 and no disk drive 112, thereby reducing the manufacturing cost of the printing device.

Network interface 114 provides a connection between printing device 100 and a data communication network. The network interface 114 allows devices coupled to a common data communication network to send print jobs, menu data, and other information to printing device 100 via the network. Similarly, serial/parallel interface 116 provides a data communication path directly between printing device 100 and another electronic or computing device. Although printing device 100 is illustrated having a network interface 114 and serial/parallel interface 116, a particular printing device may only include one such interface component.

Printing device 100 may also include a user interface and menu browser 118, and a display panel 120. The user interface and menu browser 118 allow a user of the printing device 100 to navigate the printing device's menu structure. User interface 118 may be implemented as indicators or as a series of buttons, switches, or other selectable controls that are manipulated by a user of the printing device. Display panel 120 may be a graphical or textual display that provides information regarding the status of the printing device 100 and the current options available to a user through the menu structure.

Printing device 100 also includes a print unit 124 that can be controlled by a controller, such as processor 102, to cause fluid to be ejected from the print unit to selectively form a desired image on a print media. Print unit 124 includes mechanisms arranged to apply ink (e.g., liquid ink) selectively to the print media such as paper, plastic, fabric, or the like in accordance with print data corresponding to a print job. Such mechanisms can comprise one or more print cartridge(s) 126. The print unit can also include various suitable means for moving the print cartridge(s) 126 and/or print media relative to one another.

Commonly, processor 102 is electrically coupled to, but distinct from print cartridge 126. However, other suitable embodiments can employ a processor or other suitable controller as a component of an exemplary print cartridge or other MEMS device.

Figure 2:
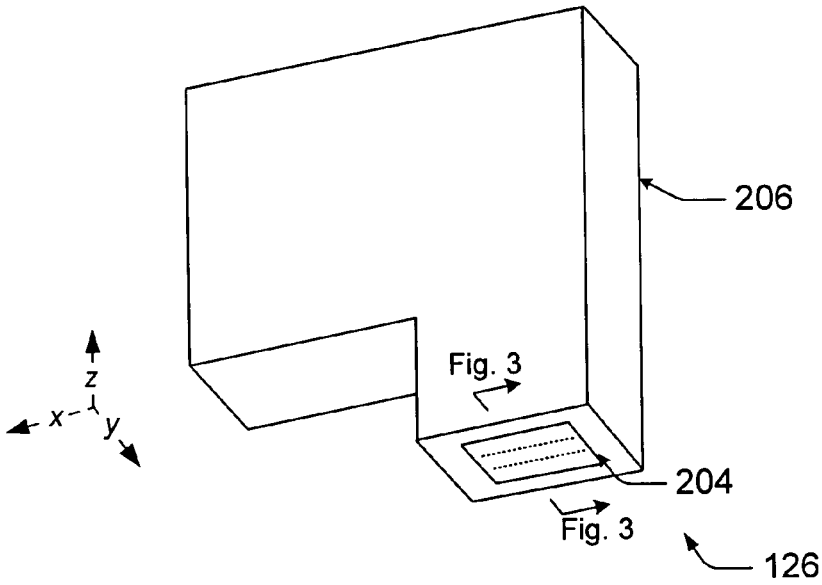
FIG. 2 shows a perspective view of an exemplary print cartridge in accordance with one embodiment.

FIG. 2 shows an exemplary print cartridge 126 that can be used in an exemplary printing device such as printer 100. Print cartridge 126 is comprised of print head 204 extending along a long axis x, and cartridge body 206. While a single print head is shown on print cartridge 126, other print cartridges may have multiple print heads on a single print cartridge. Some suitable print cartridges can be disposable while others can have a useful lifespan equal to or exceeding that of the printing device. Other exemplary configurations will be recognized by those of skill in the art.

Figure 3:
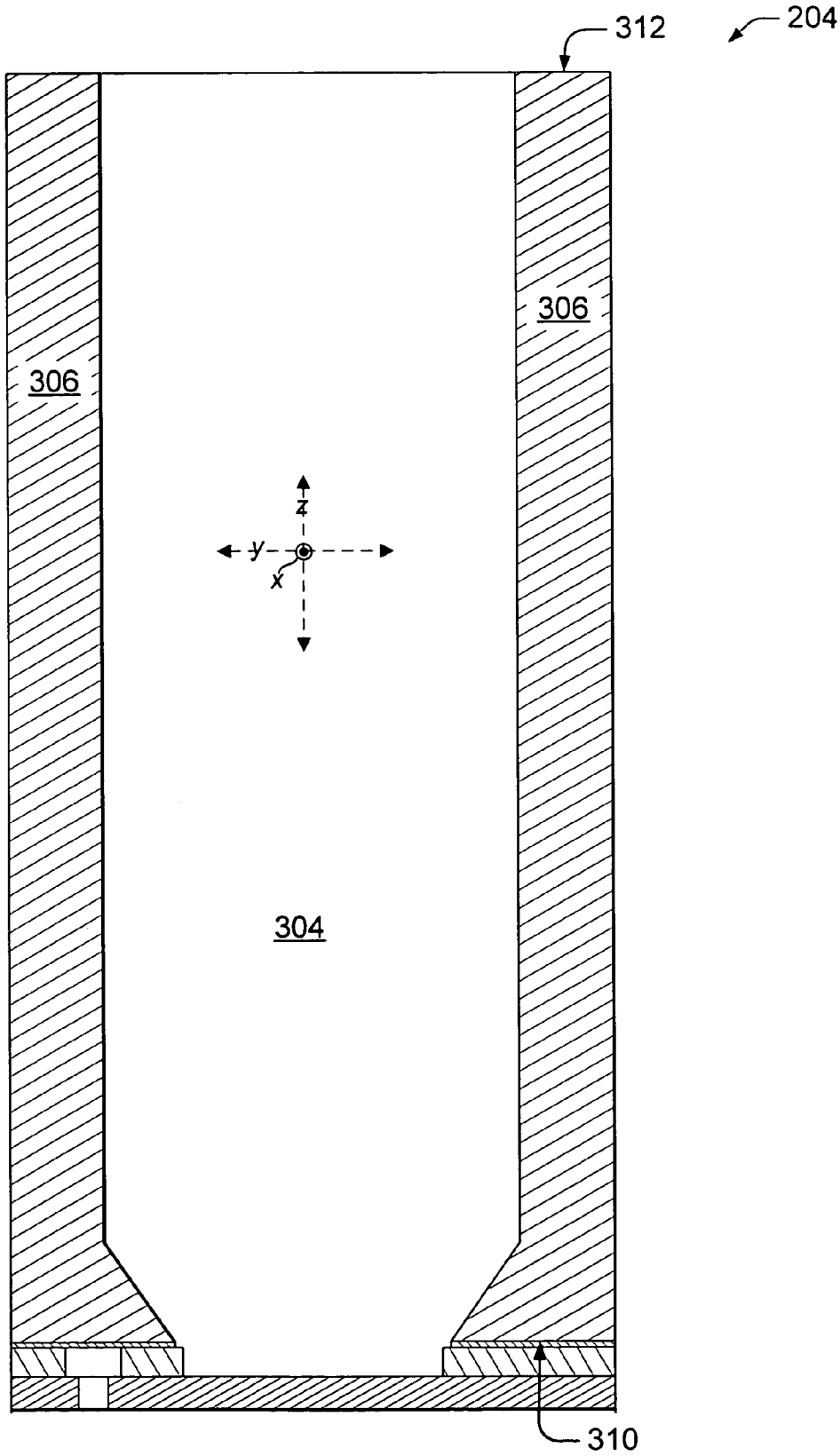
FIG. 3 shows a cross-sectional view of a portion of an exemplary print head as shown in FIG. 2 in accordance with one embodiment.

FIG. 3 shows a cross-sectional representation of print head 204 as shown in FIG. 2. This cross-sectional view is taken transverse long axis x, or described another way, along the y-axis which corresponds to a short axis of print head 204. A slot or slots 304 passes through a substrate 306 from a first substrate surface 310 to a generally opposite second substrate surface 312. Slot 304 can have any suitable dimensions. For example, the slot can have any suitable length as measured parallel to the x-axis, with some embodiments having slots in the range of 20,000 microns. Similarly, any suitable slot width taken parallel to the y-axis can be utilized, with many embodiments utilizing slot widths in the 100–200 micron range. Both narrower and wider widths are also suitable.

Substrate 306 can be comprised of silicon, gallium arsenide, glass, silica, ceramics, or a semi-conducting material among other materials. Substrate 306 can comprise various configurations as will be recognized by one of skill in the art. At present 675 micron thick substrates are often utilized, but thinner and/or thicker substrate can also be utilized. For example, if the current trend toward miniaturization continues, future embodiments may commonly utilize substrates having a thickness of 100–300 microns or smaller.

Figure 4:
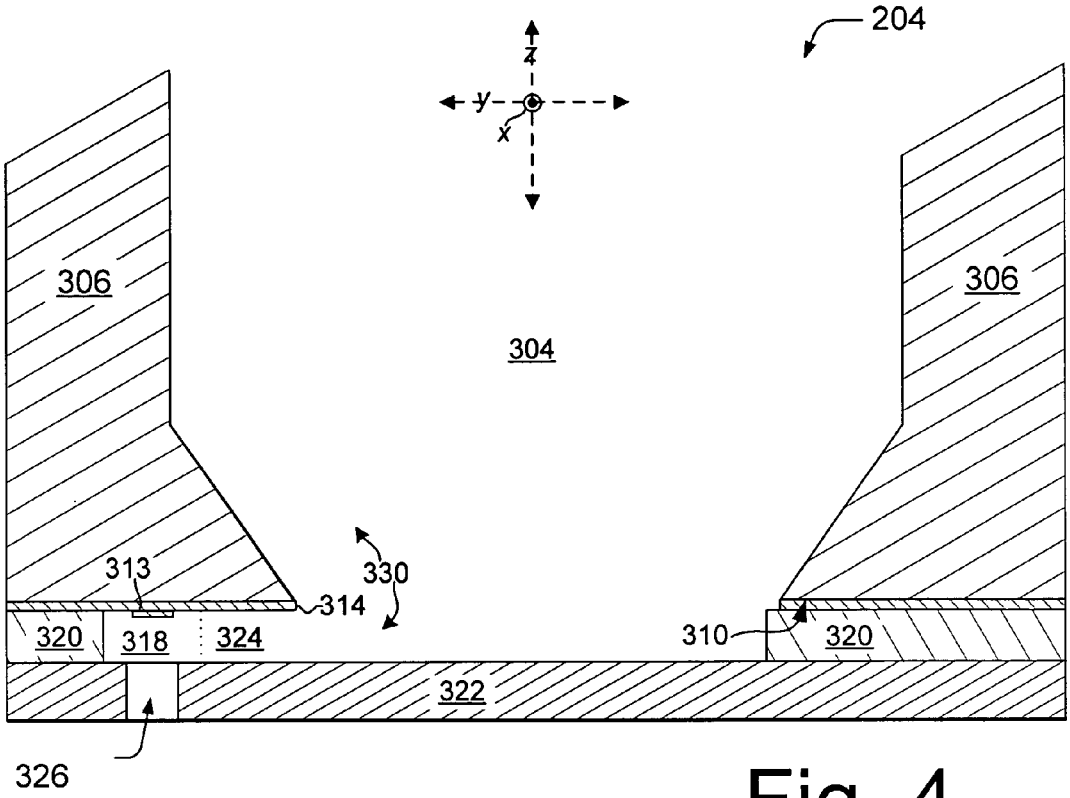
FIG. 4 shows an enlarged cross-sectional view of a portion of the exemplary print head shown in FIG. 3 in accordance with one embodiment.
Figure 5:
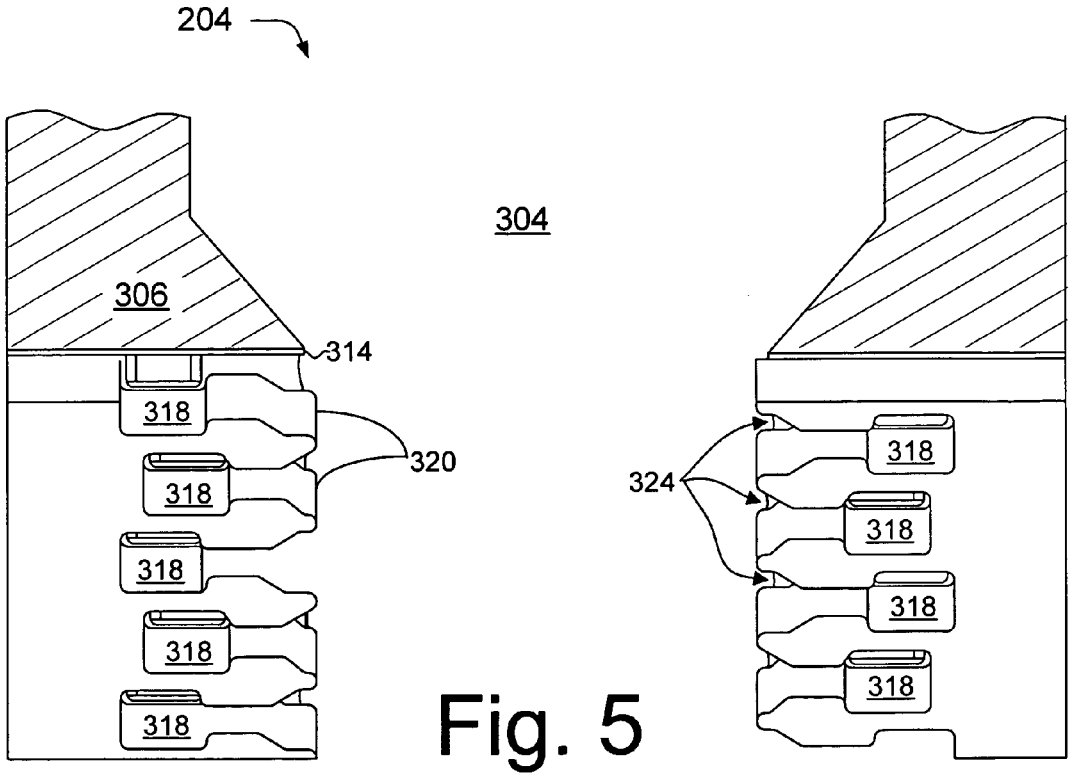
FIG. 5 shows a front elevational view of a portion of the exemplary print head shown in FIG. 3 in accordance with one embodiment.

FIGS. 4–5 show a portion of print head 204 in more detail. FIG. 4 shows a cross-sectional view similar to FIG. 3, while FIG. 5 shows a front elevational view of a cross-sectioned portion of the print head. Various electrical components such as energizing elements and electrical traces (not shown) can be formed over first surface 310. In this particular embodiment energizing elements comprise resistors 313. Other suitable embodiments can utilize other types of energizing elements such as piezoelectric crystals, among others. Individual resistors 313 are electrically connected to individual electrical traces through which electrical energy can be selectively provided to the respective resistor.

Resistors 313 and traces can comprise a portion of a stack of thin film layers 314 positioned over first surface 310. Individual resistors 313 can be positioned within or proximate to an individual ejection chamber 318. In some embodiments ejection chamber(s) 318 can be defined, at least in part, by a barrier layer 320 and an orifice plate or orifice layer 322. Other configurations are also possible. The orifice layer has been removed in FIG. 5 to allow underlying components to be better visualized. Ink can be supplied along a portion of a channel 330 from slot 304 to ejection chamber 318 via a passageway 324. In this embodiment passageway 324 is patterned into barrier layer 320. Orifice layer 322 has nozzles 326 formed therein and corresponding to individual ejection chambers 318. As will be recognized by the skilled artisan, this is but one suitable configuration.

Barrier layer 320 can comprise, among other things, a patternable material such as a photo-imagable polymer substrate. In one embodiment, orifice layer 322 comprises a nickel substrate. In another embodiment, orifice layer 322 is the same material as the barrier layer. The various layers can be formed, deposited, or attached upon the preceding layers. The configuration given here is but one possible configuration. For example, in an alternative embodiment, orifice layer 322 and barrier layer 320 are integral.

When print cartridge 126 is positioned for use, ink can flow from the cartridge body 206 (shown FIG. 2) into slot 304 of print head 204. From slot 304 ink can travel through passageway 324 that leads to ejection chamber 318. Ink can be ejected selectively from ejection chamber 318 by energizing a respective resistor 313 at a first intensity selected to sufficiently vaporize some of the ink adjacent to the resistor surface and contained in the ejection chamber. Such vaporization can increase pressure within ejection chamber 318 sufficiently to expel a desired amount of the ink.

Print head 204 is configured to replace the ink expelled from ejection chamber 318 via an individual passageway 324 supplying the ejection chamber. However, a contaminant such as one or more bubbles can occlude or obstruct the passageway 324 and prevent or slow the replacement of the ejected ink. Such bubbles can be carried into position by the ink, can be caused by 'out-gassing' from the ink, and/or can be generated during vaporization of the ink, among other origins.

Figure 6:
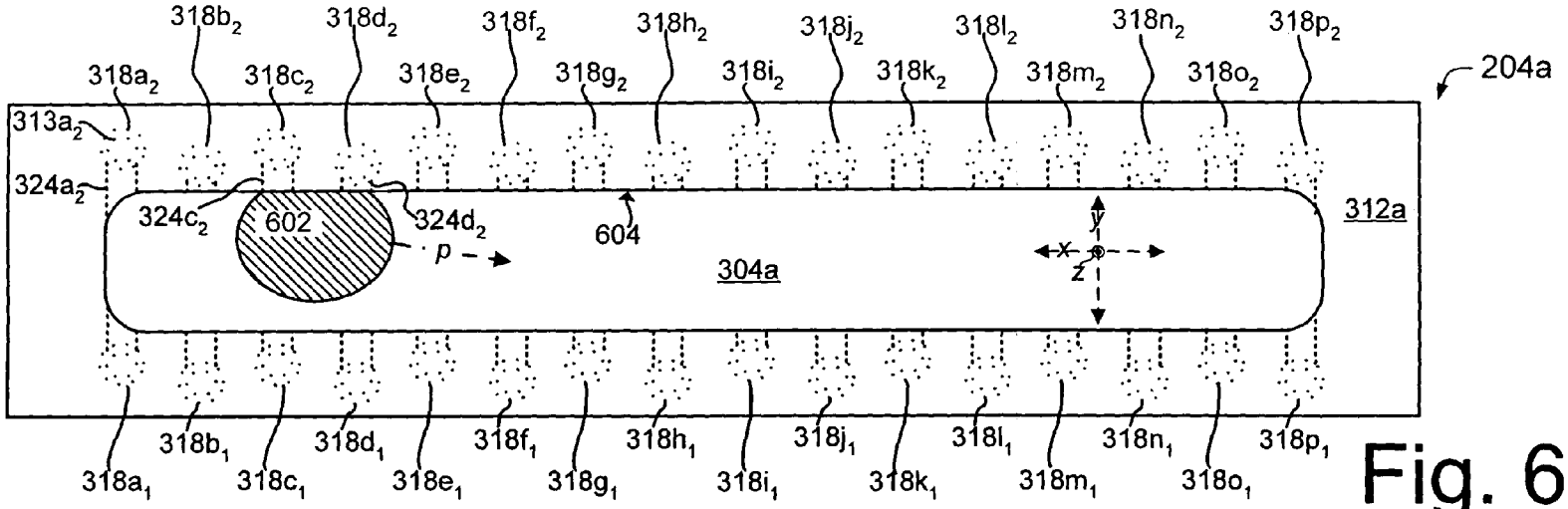
FIG. 6 shows a top view of an exemplary print head in accordance with one embodiment.
Figure 7:
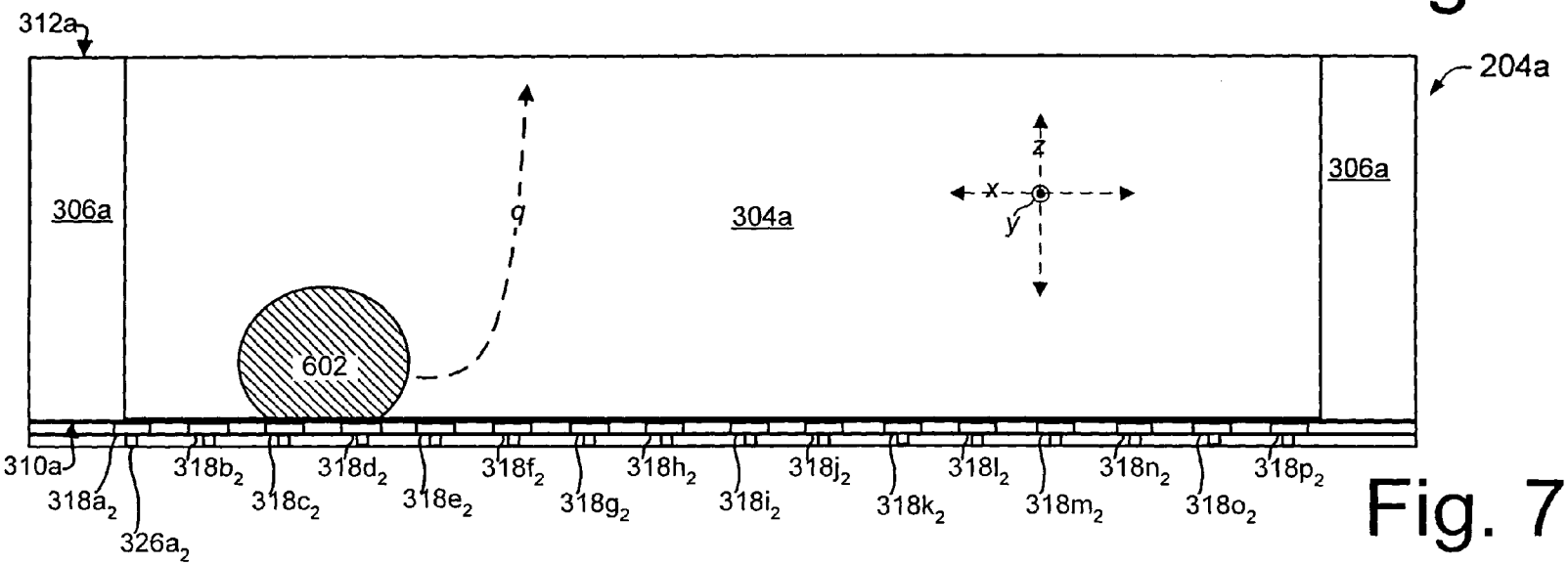
FIG. 7 shows a cross-sectional view taken along a long axis through the exemplary print head shown in FIG. 6 in accordance with one embodiment.

FIGS. 6–7 show views along a long axis x of another exemplary print head 204*a*. FIG. 6 shows a view from above a second surface 312*a* of substrate 306*a*, while FIG. 7 shows a view through a long axis of slot 304*a* that is parallel to the x-axis, and is generally orthogonal to first surface 310*a* and second surface 312*a*.

Ejection chambers 318$a_1$–318$p_2$ are shown with respective passageways, resistors and nozzles. For the sake of clarity in FIGS. 6–7, not all of the passageways, resistors and nozzles are labeled, but an example is indicated in relation to ejection chamber 318$a_2$ which has a respective resistor 313$a_2$ positioned proximate thereto. Ejection chamber 318$a_2$ is in fluid flowing relation to passageway 324$a_2$ and nozzle 326$a_2$ (shown FIG. 7). FIG. 6 shows the resistors, ejection chamber, and passageways in dashed lines to indicate that they may be obscured in this view by portions of substrate 306*a*. In this embodiment each of the individual ejection chambers is equipped with a resistor and is therefore capable of ejecting ink. In some embodiments some of the ejection chambers, sometimes referred to as "dummy chamber(s)", are not equipped with a resistor or are not intended to be used to eject ink, but instead provide other functions. For example, dummy chambers may be incorporated at the slot end of some embodiments to provide more equal operating conditions to each of the functional ejection chambers.

FIGS. 6–7 further show a bubble 602 occupying a portion of slot 304*a*. As shown here, bubble 602 is positioned against sidewall 604 and is occluding and/or reducing ink flow to the passageways 324$c_2$, 324$d_2$. Though a single bubble 602 is illustrated here, the description is equally applicable to multiple bubbles.

A controller, such as processor 102 can be configured to cause individual resistors to b e energized for a period of time and to an energy level sufficient to eject ink from one or more ejection chambers. The controller can cause ink to be ejected from one or more ejection chambers in a bubble moving pattern which is designed to move a bubble.

In some embodiments, such a bubble moving pattern can be designed to detach a bubble from a wall defining a fluid-feed channel. In this embodiment, the bubble moving pattern comprises sequentially ejecting fluid from multiple ejection chambers to detach the bubble 602 from sidewall 604 and to move it in a desired direction indicated by arrow p toward the center of slot 304*a*. From this location, due to buoyancy forces among others, bubble 602 may more easily float up and out of slot 304*a* as indicated generally by arrow q.

In this particular embodiment fluid is ejected from ejection chambers 318$c_1$ and 318$d_2$ followed by 318$d_1$ and 318$e_2$, and then 318$e_1$ and 318$f_2$. In an alternative embodiment fluid can be ejected sequentially from ejection chambers 318$d_2$, 318$e_2$, and 318$f_2$ to move bubble 602. This ink ejection creates ink movement which moves the bubble in slot 304*a*. In this embodiment the ink movement moves the bubble generally along a path indicated by arrow p.

Other suitable embodiments may utilize a bubble moving pattern designed to move a bubble within the slot to an area designed to handle bubbles. Examples of such areas can include areas and/or structures designed to promote the bubble to migrate out of the slot. In one such example, bubbles are moved to a location within the slot where the bubble can be evacuated from the slot.

Figure 8:
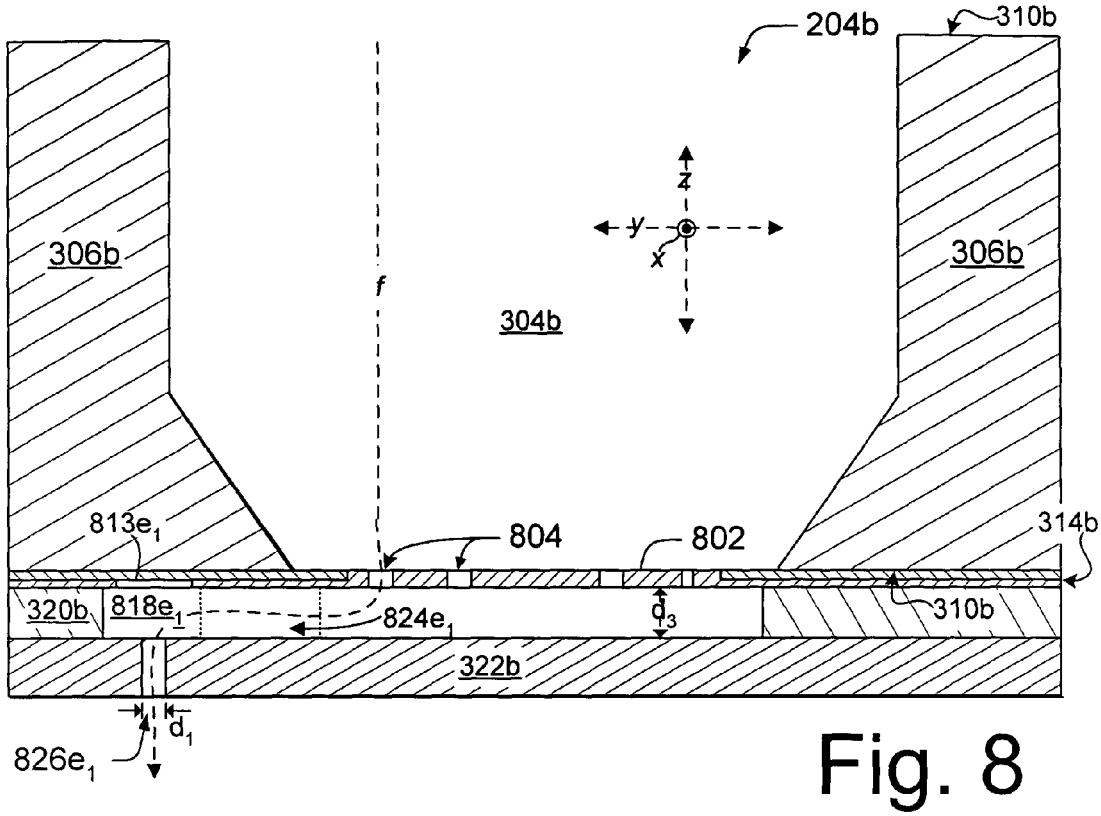
FIG. 8 shows an enlarged cross-sectional view of a portion of an exemplary print head in accordance with one embodiment.
Figure 9:
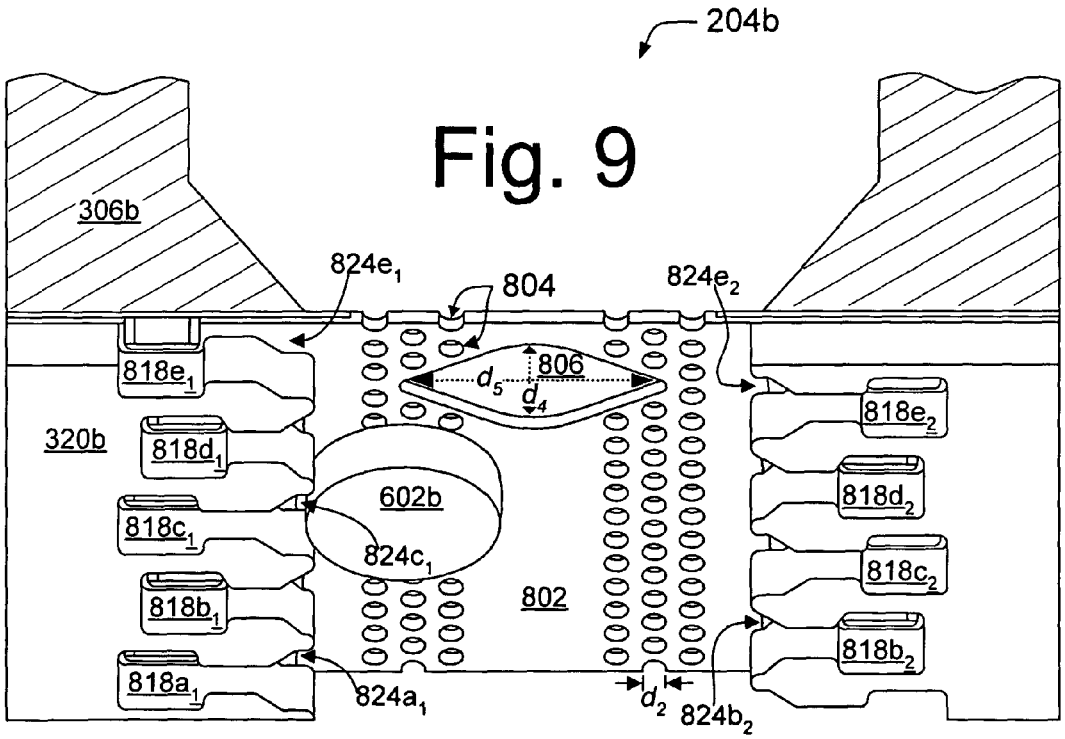
FIG. 9 shows a front elevational view of a portion of the exemplary print head shown in FIG. 8 in accordance with one embodiment.

FIGS. 8–9 show another exemplary print head 204*b*. FIG. 8 shows a cross-section taken transverse to the print head's long axis x which extends into and out of the page on which FIGS. 8–9 appear. FIG. 9 shows a front elevational view of a cross-section taken through print head 204*b*. As shown in FIG. 9, orifice layer 322*b* has been removed to allow underlying components to be more easily observed.

In the embodiment shown in FIGS. 8–9, a filter 802 is positioned across an ink flow path *f* of print head 204*b*. The print head comprises substrate 306*b* that has slot 304*b* formed therethrough between first and second surfaces 310*b*, 312*b*. In this particular embodiment, filter 802 is positioned between the substrate's first surface 310*b* and various passageways 824$a_1$–824$e_2$ which supply respective ejection chambers 818$a_1$–818$e_2$ so that ink passes through the filter as it travels through print head 204*b*.

In this particular embodiment, filter 802 has apertures formed therein and defines a border between slot 304*b* and the ink feed passageways 824$a_1$–824$e_2$. To enhance clarity, not all of passageways 824$a_1$–824$e_2$ are specifically designated, but individual passageways supply correspondingly labeled ejection chambers 818$a_1$–818$e_2$.

In this embodiment filter 802 comprises a generally planer photo-imagable polymer filter layer positioned over the substrate's first surface 310*b*. The photo-imagable polymer layer has apertures formed therein through which ink can flow. In this particular embodiment the photo-imagable filter layer is spun-on over the thin-film layers 314*b* prior to completion of slot 304*b*. The photo imagable filter layer is patterned and etched to form the apertures. Further, in this embodiment, barrier layer 320*b* is positioned over the photo-imagable filter layer before etching. The skilled artisan will recognize other suitable configurations. For example, other filters may comprise different materials and/or may utilize other aperture shapes and/or sizes. In one such example, a stainless steel filter may be utilized with generally square apertures.

In this embodiment the apertures comprise a first size aperture ("first aperture") 804 and a second larger size aperture ("second aperture") 806. Also, in this embodiment, first aperture(s) 804 have a cross-sectional area chosen in relation to various components of print head 204*b*. For example, in this embodiment, orifice layer 322*b* has multiple nozzles corresponding to respective ejection chambers. One such nozzle is designated 826$e_1$. Individual nozzles can have a cross-sectional bore diameter $d_1$ of about 15 microns. Accordingly, the first aperture(s) 804 can have a cross-sectional dimension $d_2$ slightly smaller than the nozzle's bore diameter $d_1$ to exclude contaminants that might lodge in or otherwise block a nozzle.

In this embodiment the first aperture(s) 804 can have a cross-sectional dimension of about 14 microns or less. In this particular embodiment the first aperture(s) 804 are generally circular so the cross-sectional dimension $d_2$ is the diameter.

When print head 204*b* is utilized for printing, a bubble or bubbles may form and/or get lodged between orifice layer 322*b* and filter 802. As shown here, a bubble 602*b* is proximate to, and occluding, ejection chamber 818$c_1$ via passageway 824$c_1$. Ink can be ejected from one or more ejection chambers in a bubble moving pattern utilized to move bubble 602*b* and restore ink flow. In this embodiment bubble 602*b* can be moved toward second aperture 806 to allow the bubble to exit into slot 304*b*. Ink can be ejected by energizing individual resistors such as resistor 813$e_1$ shown here.

Second aperture 806 can have a shape and location based on several criteria, including but not limited to, a distance $d_3$ extending normally between filter 802 and orifice layer 322*b*. In this embodiment, second aperture 806 has a minimum dimension $d_4$ which is larger than the filter 802 to orifice layer 322*b* dimension $d_3$. In this embodiment, a diamond shape second aperture 806 is utilized where the minimum dimension $d_4$ comprises the width, and the length comprises dimension $d_5$.

In this particular embodiment second aperture 806 is about 20–30 microns wide and 50–60 microns long. Such a configuration of the second aperture dimensions relative to the filter 802 to orifice plate 322*b* dimension can facilitate passage of bubble 602*b* into slot 304*b*. Stated another way, bubbles may tend to migrate through the second aperture if the dimensions of the second aperture are larger than the filter to orifice plate dimension. This is but one suitable example. Other suitable apertures may have smaller or larger dimensions. Though a diamond shaped second aperture 806 is shown here, other suitable embodiments can utilize other geometric shapes including but not limited to rectangles, circles and/or irregular shapes. Further, though only a single second aperture 806 is utilized in this embodiment, other suitable embodiments may utilize more than one of the second apertures.

Figure 10:
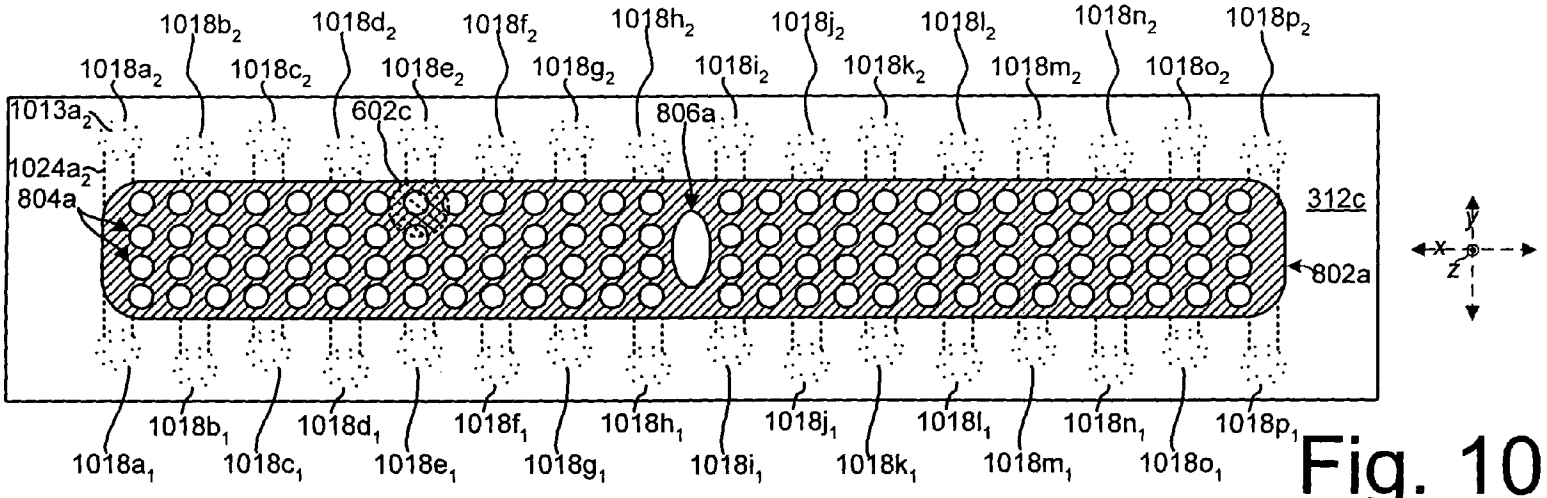
FIG. 10 shows a top view of an exemplary print head in accordance with one embodiment.
Figure 11:
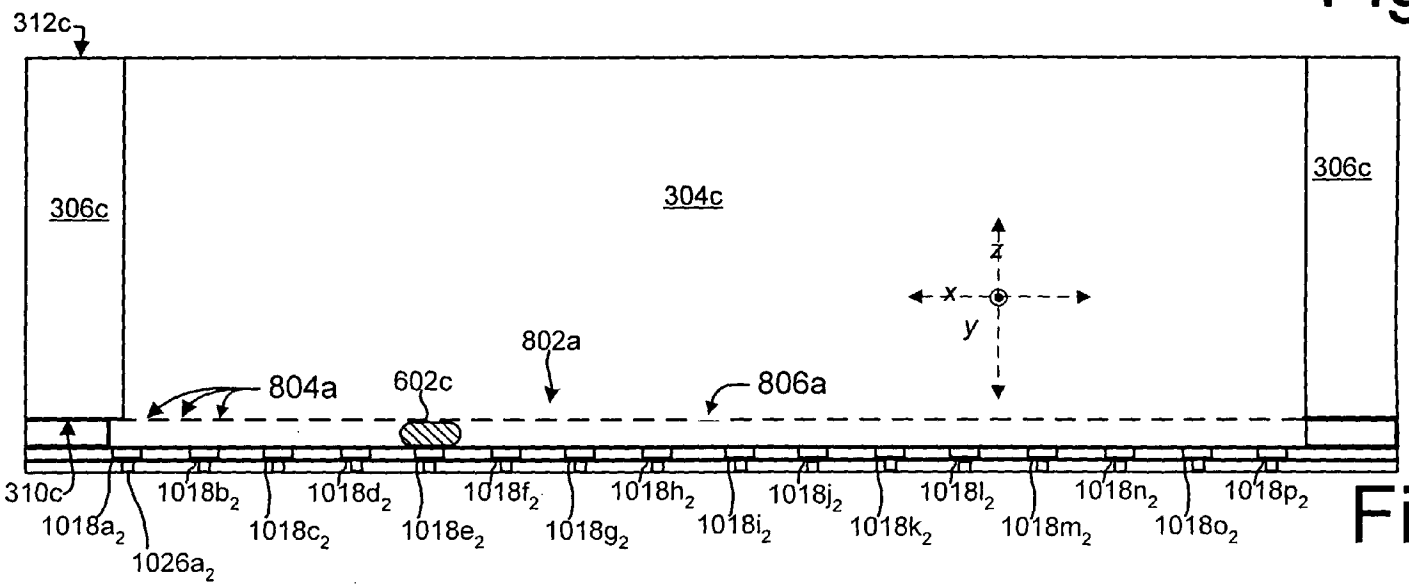
FIG. 11 shows a cross-sectional view taken along a long axis through the exemplary print head shown in FIG. 10 in accordance with one embodiment.

FIGS. 10–11 show another embodiment similar to the one shown in FIGS. 8–9. FIGS. 10–11 show views taken along a long axis of a slot 304*c* where the long axis is generally parallel to the x-axis. FIG. 10 is taken from above second surface 312*c*, while FIG. 11 is orthogonal to the second surface 312*c*.

A filter 802*a* is positioned below first surface 310*c* of substrate 306*c*. Filter 802*a* has first apertures 804*a* and a second aperture 806*a*. Multiple ejection chambers 1018$a_1$–1018$p_2$ are shown with respective resistors, passageways and nozzles. For the sake of clarity in FIGS. 10–11 not all of the resistors, passageways, and nozzles are labeled, but an example is indicated in relation to ejection chamber 1018$a_2$ with proximate resistor 1013$a_2$, passageway 1024$a_2$ and nozzle 1026$a_2$ (shown FIG. 11).

A bubble 602*c* can be seen beneath filter 802*a* and proximate to ejection chamber 1018$e_2$. Ink can be ejected from individual ejection chambers in a bubble moving pattern designed to move bubble 602*c* toward second aperture 806*a* so that the bubble can pass through the filter.

Various suitable patterns can be utilized to achieve the bubble moving pattern. For example, one suitable pattern comprises sequentially ejecting ink from pairs of ejection chambers to create ink flow to move any bubbles toward second aperture 806*a*. In one such example ink is ejected from ejection chamber pair 1018$f_1$–1018$f_2$ followed by 1018$g_1$–1018$g_2$, and then 1018$h_1$–1018$h_2$. This sequence can be followed by ejection chamber pairs 1018$g_1$–1018$g_2$ followed by 1018$h_1$–1018$h_2$, and then 1018$i_1$–1018$i_2$, etc. to progressively move bubble 602*c* toward the second aperture 806*a*.

Figure 12:
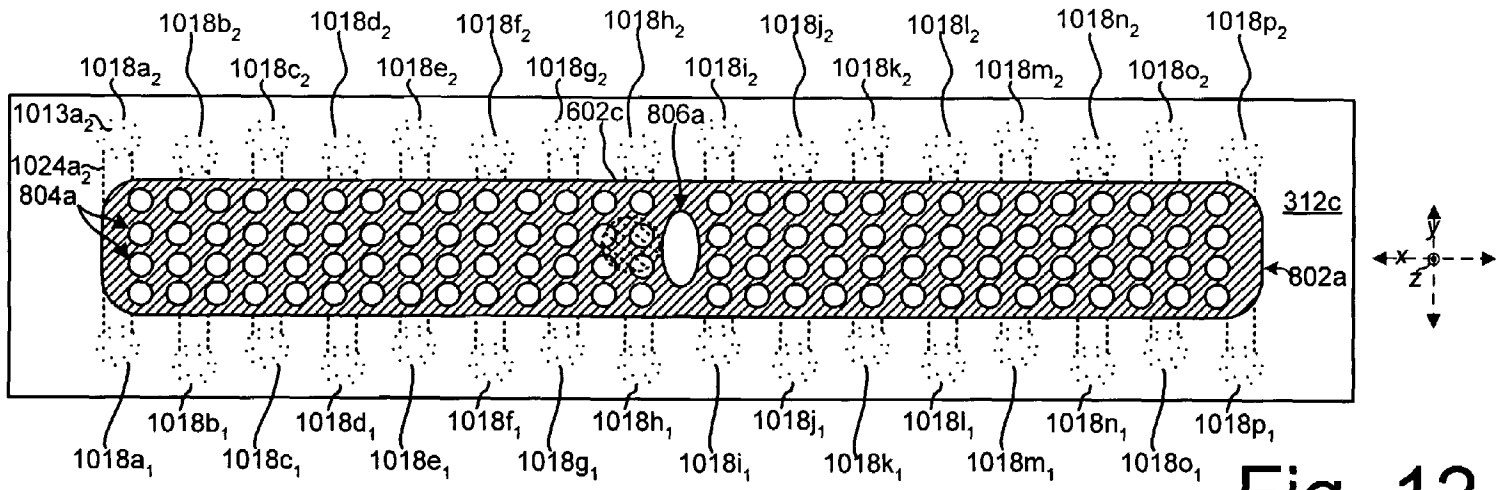
FIG. 12 shows a top view of an exemplary print head in accordance with one embodiment.
Figure 13:
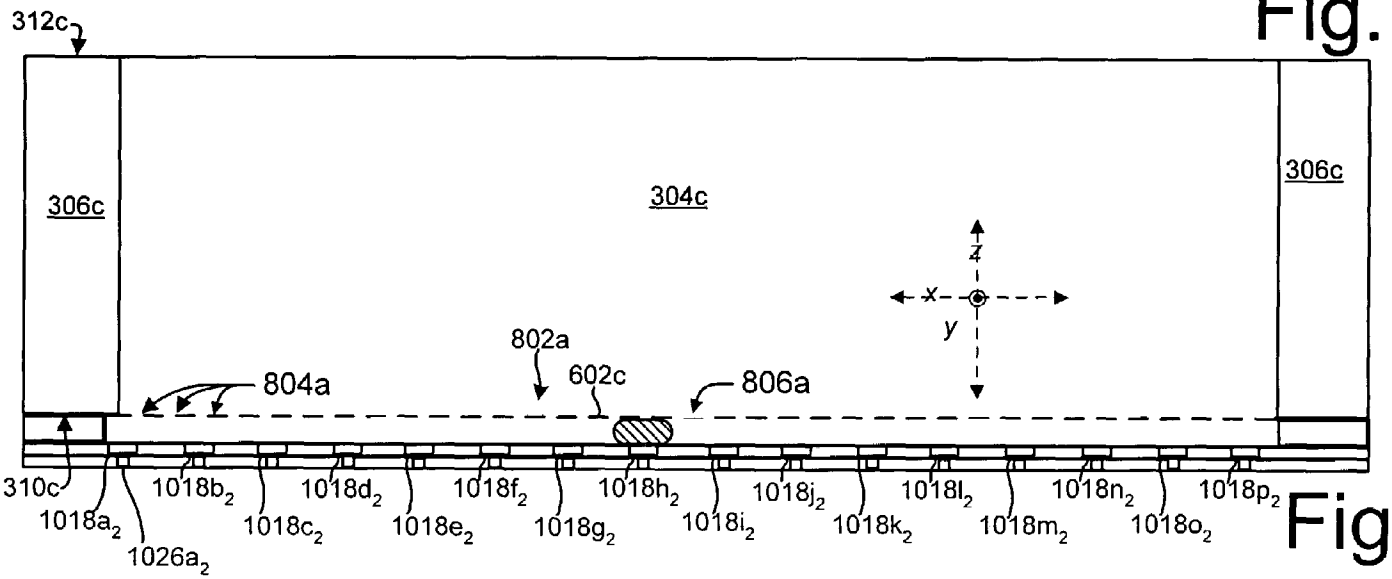
FIG. 13 shows a cross-sectional view taken along a long axis through the exemplary print head shown in FIG. 11 in accordance with one embodiment.
Figure 12A:
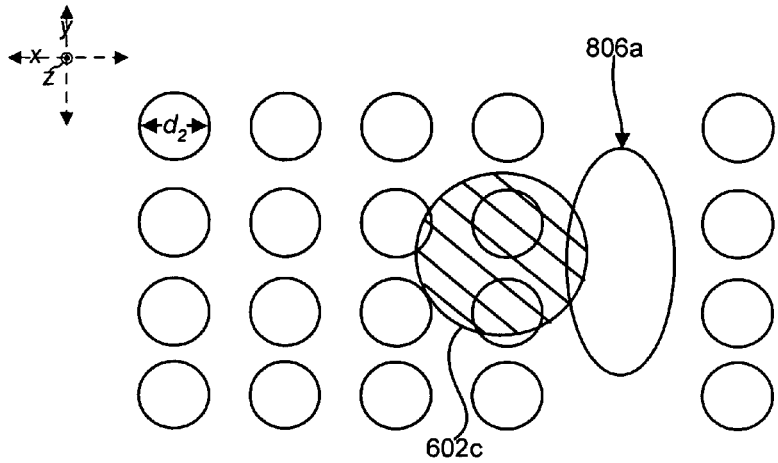
FIGS. 12*a* and 12*b* show an enlarged top view of a portion of the exemplary print head shown in FIG. 12 in accordance with one embodiment.
Figure 13A:
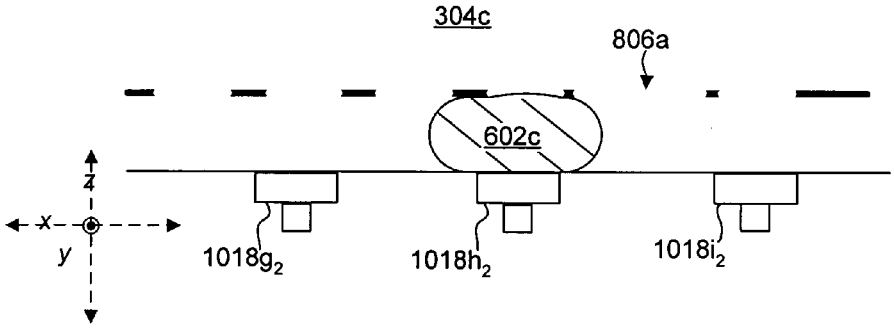
FIGS. 13*a* and 13*b* show an enlarged cross-sectional view of a portion of the exemplary print head shown in FIG. 13 in accordance with one embodiment.
Figure 12B:
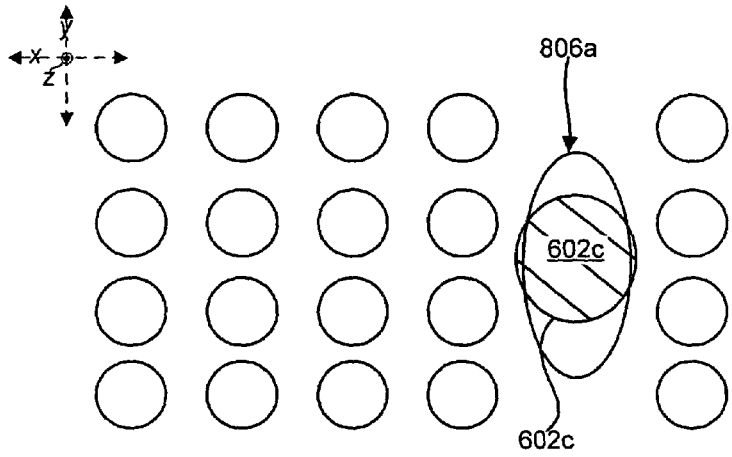
Figure 13B:
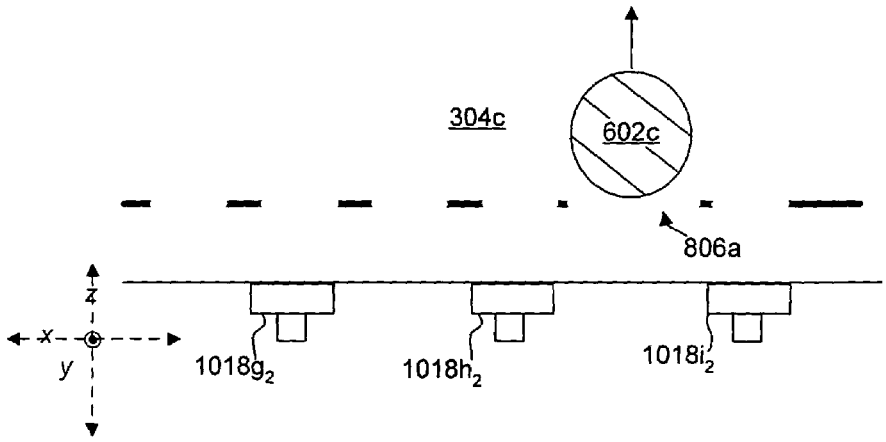

FIGS. 12–13 show views similar to those shown in FIGS. 10–11 respectively, with the exception that bubble 602*c* now is positioned closer to second aperture 806*a*.

FIGS. 12*a*–13*a* show enlarged views of a region surrounding bubble 602*c* as shown in FIGS. 12–13 respectively. Once bubble 602*c* is proximate to second aperture 806*a* it can migrate through aperture 806*a* upward into slot 304*c* as shown in FIGS. 12*b*–13*b*. Though this example only describes sequentially ejecting ink from ejection chambers located at one end of the slot and moving toward those which are generally centrally located along the slot, many other suitable bubble moving patterns can be utilized. For example, a similar pattern may be simultaneously utilized at the other end of the slot to simultaneously move bubbles from both ends toward second aperture 806*a*.

As shown in this embodiment, second aperture 806*a* is generally centrally located within slot 304*c* so that bubbles on the right side can be moved toward the center and similarly bubbles on the left can be moved toward the center. Bubbles then may pass through second aperture 806*a* of the filter 802*a* and may migrate out of slot 304*c*. The bubbles can then migrate upward, exiting the slot unaided and/or further energizing can be utilized to facilitate desired movement of the bubbles. A similar suitable embodiment can locate second aperture 806*a* near one end of the slot and move bubbles toward that end.

Ejecting ink in a bubble moving pattern can be achieved in any suitable manner. In one such embodiment, a controller or processor such as processor 102 can cause various resistors to be energized to eject ink to achieve the desired bubble moving pattern. The processor can cause such energizing by, including but not limited to, processing various computer readable instructions which are stored on suitable computer readable media, examples of which are provided above. The computer readable instructions may be contained on the printing device or may be imported from another computing device via a network connection.

Bubble management can be implemented in various suitable configurations. For example, in one such embodiment, a printing device may be equipped with an ink droplet detector that checks for proper print head function from time to time. If the detector indicates that the print head is not operating within desired parameters, such as would be caused from ink starvation of one or more ejection chambers, then the processor may cause ink to be ejected in a bubble moving pattern to move any bubbles which may cause such starvation.

In other embodiments, the processor may cause ink to be ejected in a bubble moving pattern based upon one or more suitable parameters such as passage of a given period of time and/or a number of lines or pages printed. For example, one suitable embodiment may from time to time simply cause the print cartridge to be positioned over a service station or other suitable receptacle and eject ink from one or more ejection chambers in a bubble moving pattern as a preventive measure. This particular example can operate without any system for determining the presence and/or location of bubbles in the print head.

Other suitable embodiments may alternatively or additionally monitor other conditions relative to the print head to determine when ink should be ejected to create ink movement to manage bubbles and in what pattern. For example, operating conditions such as temperature can affect bubble formation so that some suitable embodiments may interrelate the incidence of bubble management with a sensed temperature of the print head or portions thereof. Still other embodiments may be designed from feedback based on lab data which indicates a propensity for bubbles to gather in a particular area of a given print head design. The bubble moving patterns can be selected based on this data to promote bubble movement away from these particular areas.

The described embodiments can provide methods and systems for managing contaminants along a fluid-feed path of a MEMS device. The contaminants, such as bubbles, can be managed by ejecting fluid from at least one ejection chamber in a bubble moving pattern designed to move and/or dislodge bubbles in the fluid. Such fluid ejection can create movement of fluid remaining in the device which can move the bubbles to a desired location along the fluid-feed path.

Although the inventive concepts have been described in language specific to structural features and methodological steps, it is to be understood that the appended claims are not necessarily limited to the specific features or steps described. Rather, the specific features and steps are disclosed as forms of implementation.

What is claimed is:

1. A device comprising:

multiple ejection chambers positioned in a print head, individual ejection chambers comprising an ejection element, the print head defining a fluid-feed path configured to supply fluid to the ejection chambers for ejection from the print head;

a filter extending generally across the fluid-feed path; and, a controller configured to cause ejection elements to be energized sufficiently to cause fluid to be ejected from one or more of the ejection chambers in a pattern designed to move a bubble to a region where the bubble can pass through the filter.

2. The device of claim 1, wherein the filter comprises a generally planar surface that extends generally transverse the fluid-feed path.

3. The device of claim 1, wherein the multiple ejection chambers are arranged in a generally linear array which lies generally parallel to a long axis of a fluid-feed slot defining a portion of the fluid-feed path, and wherein the controller is configured to cause fluid ejection in a pattern comprising a sequential pattern involving ejecting fluid from at least two adjacent ejection chambers.

4. The device of claim 1, wherein the multiple ejection chambers are arranged in pairs with a member of each pair located on opposing sides of the fluid-feed slot along an axis generally orthogonal to a long axis of the fluid-feed slot, and wherein the controller is configured to sequentially eject fluid from adjacent pairs to move the bubble from a first end of the slot toward a second generally opposing end of the slot.

5. The device of claim 1, wherein the multiple ejection chambers are arranged in pairs with a member of each pair located on opposing sides of a fluid-feed slot which defines a portion of the fluid-feed path, and wherein the controller is configured to sequentially eject fluid from adjacent pairs to move the bubble from at least one of a first and a second end of the fluid-feed slot toward the other of the first and second end of the fluid-feed slot.

6. The device of claim 1, wherein the filter comprises a photo-imaginable polymer layer having apertures patterned therein.

7. The device of claim 1, wherein the filter comprises a layer having apertures patterned therein.

8. The device of claim 7, wherein the apertures are generally uniform in size.

9. The device of claim 7, wherein the layer is positioned between a silicon substrate through which the feed path passes and the multiple ejection chambers.

10. The device of claim 7, wherein individual ejection chambers comprise a nozzle and wherein a nozzle bore dimension taken transverse to the fluid-feed path is greater than a dimension of an individual aperture taken transverse the fluid-feed path.

11. The device of claim 7, wherein the apertures are generally uniform in shape.

12. The device of claim 7, wherein the apertures comprise multiple apertures of a first size and at least one second larger size aperture.

13. The device of claim 12, wherein the region is proximate to one of the second larger size apertures.

14. The device of claim 12, wherein the at least one second larger size aperture is generally diamond shaped when viewed transverse to the fluid-feed path.

15. The device of claim 12, wherein individual apertures comprising the multiple apertures of the first size are generally circular when viewed transverse to the fluid-feed path.

16. The device of claim 12, wherein the at least one second larger size aperture is centrally located on the layer.

17. A system comprising:

a fluid-feed channel configured to supply fluid to a plurality of ejection chambers; and, a processor configured to cause fluid to be ejected from one or more of the ejection chambers in a contaminant moving pattern that creates fluid flow designed to move a pre-existing contaminant contained in the fluid-feed channel in a desired direction;

wherein the contaminant moving pattern creates fluid flow from a first end of the fluid-feed channel and a generally opposing second end of the fluid-feed channel toward a region centrally located between the first end and the second end.

18. The system of claim 17, wherein the contaminant comprises a bubble.

19. The system of claim 17, wherein the contaminant comprises a particle.

20. The system of claim 17, wherein the contaminant comprises one or more bubbles and wherein the processor is configured to move the bubbles toward a structure configured to evacuate bubbles from the fluid-feed channel.

21. The system of claim 17, wherein the processor and the fluid-feed channel are incorporated in a printing device.

22. The system of claim 17, wherein the fluid-feed channel is incorporated on a printing device and the processor is incorporated in a computing device coupled to the printing device.

23. A printing device comprising:

a print head comprising multiple ejection chambers and a fluid-feed channel configured to supply fluid to the ejection chambers, wherein the ejection chambers are arranged in a generally linear array extending along a long axis of the fluid-feed channel; and, a controller configured to cause fluid ejection from individual ejection chambers in a pattern designed to move a pre-existing bubble in a desired direction within the fluid-feed channel by ejecting fluid from individual ejection chambers starting at a first end of the array and progressing to a second generally opposing end of the array.

24. A method comprising:

individually ejecting fluid from multiple, adjacently positioned ejection chambers of a printing device with ejection elements of a fluid cartridge that comprises the ejection chambers in a pattern designed primarily to create fluid flow to move a pre-existing contaminant present in fluid contained in a fluid-feed channel configured to supply fluid to the multiple ejection chambers; and, responsive to said ejecting, moving fluid in the fluid-feed channel sufficiently to move a pre-existing contaminant in a desired direction within the fluid-feed channel.

25. A method comprising:

positioning a filter relative to a fluid supply path of a micro electro mechanical systems device so that fluid passes through the filter before reaching one or more ejection chambers of the micro electro mechanical systems device; and, configuring a processor to cause fluid to be ejected from individual ejection chambers in a pattern intended to create fluid flow sufficient to move a contaminant in a direction generally parallel to the filter to a location designed to handle contaminants.

26. The method of claim 25, wherein said act of configuring moves the contaminant comprising a bubble to the location to allow the bubble to pass through the filter.

27. One or more computer-readable media having computer-readable instructions thereon which, when executed by a device, cause the device to:

selectively energize a first ejection element to cause ejection of fluid from a first ejection chamber; and, selectively energize at least a second ejection element to cause ejection of fluid from at least a second ejection chamber, wherein said ejection from the first ejection chamber and ejection from the second ejection chamber cooperatively cause fluid flow within a fluid-feed channel supplying fluid to the chambers sufficient to move a contaminant located in the fluid-feed channel.

28. A method comprising:

ejecting fluid from multiple ejection chambers of a printing device in a pattern designed primarily to create fluid flow to move a pre-existing contaminant present in fluid contained in a fluid-feed channel configured to supply fluid to the multiple ejection chambers; and, responsive to said ejecting, moving fluid in the fluid-feed channel sufficiently to move a pre-existing contaminant from the fluid-feed channel to a central position within a slot that feeds the fluid-feed channel.

29. The method of claim 28, wherein said act of ejecting comprises ejecting fluid from adjacently positioned ejection chambers.

30. The method of claim 28, wherein said act of ejecting comprises ejecting fluid from pairs of ejection chambers where the ejection chambers comprising each pair are positioned on opposing sides of a long axis of the fluid-feed channel.

31. A system comprising:

a fluid-feed channel configured to supply fluid to a plurality of ejection chambers; and, a processor configured to cause fluid to be ejected from one or more of the ejection chambers in a contaminant moving pattern that creates fluid flow designed to move a pre-existing contaminant contained in the fluid-feed channel in a desired direction;

wherein the contaminant moving pattern creates fluid flow from a first end of the fluid-feed channel toward a generally opposing second end of the fluid-feed channel.

32. A printing device comprising:

a print head comprising multiple ejection chambers and a fluid-feed channel configured to supply fluid to the ejection chambers, wherein the ejection chambers are arranged in a generally linear array extending along a long axis of the fluid-feed channel; and, a controller configured to cause fluid ejection from individual ejection chambers in a pattern designed to move a pre-existing bubble in a desired direction within the fluid-feed channel by ejecting fluid from individual ejection chambers starting at a first end of the array and a second generally opposing end of the array and progressing toward a generally central region of the array.

33. A method comprising:

individually ejecting fluid from ejection chambers of a printing device with ejection elements of a fluid cartridge that comprises the ejection chambers in a pattern designed primarily to create fluid flow to move a pre-existing contaminant present in fluid contained in a fluid-feed channel configured to supply fluid to the multiple ejection chambers, wherein the ejecting comprises ejecting fluid from pairs of ejection chambers where the ejection chambers comprising each pair are positioned on opposing sides of a long axis of the fluid-feed channel; and, responsive to said ejecting, moving fluid in the fluid-feed channel sufficiently to move a pre-existing contaminant in a desired direction within the fluid-feed channel.

* * * * *

UNITED STATES PATENT AND TRADEMARK OFFICE

CERTIFICATE OF CORRECTION

PATENT NO. : 7,111,932 B2
APPLICATION NO. : 10/666753
DATED : September 26, 2006
INVENTOR(S) : Mike Steed et al.

It is certified that error appears in the above-identified patent and that said Letters Patent is hereby corrected as shown below:

On the face page, in field (73), in "Assignee", in column 1, line 2, after "Company," insert -- L.P., --.

In column 10, line 18, in Claim 6, delete "photo-imaginable" and insert -- photo-imagable --, therefor.

Signed and Sealed this

Fourteenth Day of April, 2009

JOHN DOLL
*Acting Director of the United States Patent and Trademark Office*